United States Patent [19]

Wehby

[11] Patent Number: 4,643,433

[45] Date of Patent: Feb. 17, 1987

[54] TARGET GAME

[76] Inventor: Timothy A. Wehby, 5870 Cedaridge Dr., Cincinnati, Ohio 45247

[21] Appl. No.: 755,495

[22] Filed: Jul. 16, 1985

[51] Int. Cl.[4] ..... A63B 67/06

[52] U.S. Cl. ..... 273/402; 273/348

[58] Field of Search ..... 273/398–402, 273/407, 348, 410, 411

[56] References Cited

U.S. PATENT DOCUMENTS

| | | | |
|---|---|---|---|
| 285,396 | 9/1883 | De Windt | 273/402 X |
| 1,616,524 | 2/1927 | Bellgarde | 273/402 |
| 2,126,245 | 8/1938 | Darby | 273/400 X |
| 2,287,113 | 6/1942 | Markey | 273/401 |
| 2,481,724 | 9/1949 | Croteau | 273/407 X |
| 3,339,925 | 9/1967 | Nissen | 273/402 |

FOREIGN PATENT DOCUMENTS

| | | | |
|---|---|---|---|
| 434891 | 12/1911 | France | 273/400 |
| WO83/02727 | 8/1983 | PCT Int'l Appl. | 273/400 |

*Primary Examiner*—Paul E. Shapiro

*Attorney, Agent, or Firm*—Wood, Herron & Evans

[57] ABSTRACT

A game in which a disc-shaped projectile is sailed toward a scoring platform. The scoring platform includes two surfaces upon which, or against which, the projectile may come to rest, and further includes a frame having an opening therethrough, through which the projectile may pass. Different points are awarded a player depending upon the disc-shaped projectile coming to rest upon one of the surfaces or passing through the opening.

3 Claims, 2 Drawing Figures

TARGET GAME

DESCRIPTION OF THE INVENTION

The invention relates generally to games, and more particularly concerns a target game employing a projectile.

There are a number of games involving directing a projectile toward a target, with the movement or position of the projectile relative to the target according a player a certain number of points or the like. Projectiles for use in such games include darts, balls, horse shoes, and saucer-shaped, or disc-shaped, projectiles, which may be sailed toward a target. Targets for such games include boards, stacks of objects, posts, and other arrangements.

In such target games employing disc-shaped projectiles, targets used have included nets and vertically-oriented rings, through which a projectile may pass. It is the general aim of the present invention to provide an improved target for such disc-shaped projectile-employing games, which provides a number of scoring possibilities with a single target.

In one form of the invention, the improved target includes a scoring platform having a generally horizontal surface upon which the projectile may come to rest, and a frame providing several openings through which the projectile may pass. There is additionally provided a rear, vertical, surface at the rear edge of the horizontal surface, to serve as a backstop for a disc-shaped projectile sailed toward the target. As shall be described in more detail hereinafter, various point values are accorded for landing the disc-shaped projectile on the horizontal surface, for sailing the projectile through one of the openings in the scoring platform frame, and for touching the platform with the projectile.

Figure 2:
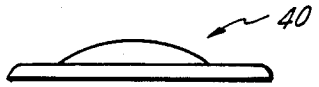
Figure 1:
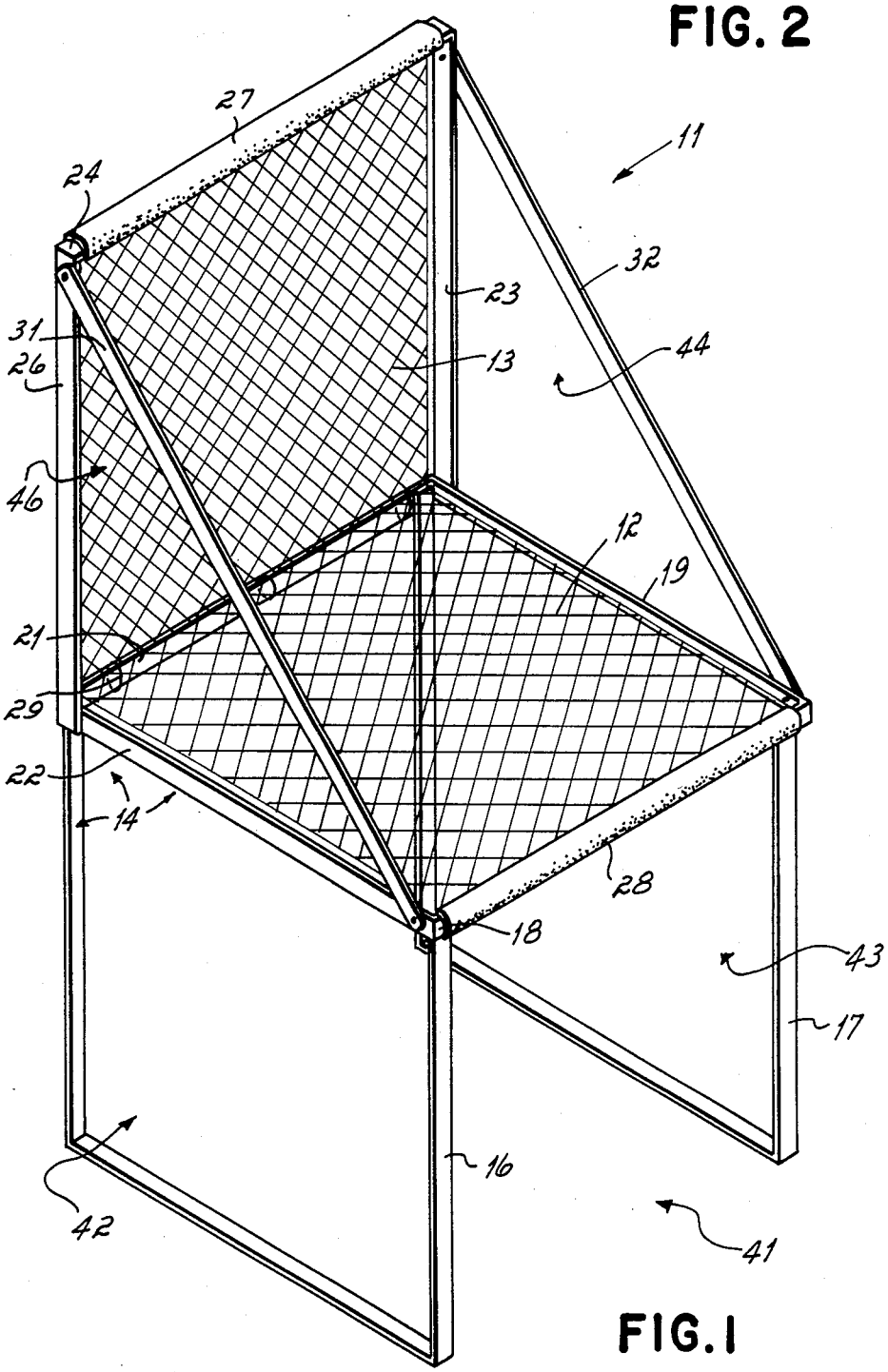

Various advantages of the invention, and the manner of their implementation, will become apparent upon reading the following detailed description and upon reference to the drawings, in which:

FIG. 1 is a perspective view of a scoring platform for use in the game of the present invention; and FIG. 2 is a side view of an exemplary disc-shaped projectile for use in playing the game.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives following within the spirit and scope of the invention as defined by the appended claims.

With reference now to the drawings, a scoring platform 11 for a disc-shaped projectile sailing game includes a horizontal surface 12 and a vertical surface 13 supported by a frame, indicated generally as 14. The frame 14 includes a base made up of two spaced apart frame members 16, 17, each of which is formed in a generally U-shape. The horizontal surface 12 is bounded by four rigid frame members 18, 19, 21 and 22. These four frame elements are rigidly secured to one another and also rigidly attached to the two frame members 16, 17 of the base. The vertical surface 13 is defined by the frame element 21 and three additional frame elements 23, 24 and 26, which are also rigidly secured to one another.

The surfaces 12, 13 are formed from a mesh or webbing which is attached at a first end to the frame element 24 by a suitable retaining tube 27 and at its other end to the frame element 18 by a retaining tube 28. The webbing of the surfaces 12, 13 is also attached to the frame element 21 by suitable ties or loops such as 29.

For purposes of scoring, to be described hereinafter, the scoring platform 11 further includes two angled frame elements 31, 32 extending between the frame element 24 and the frame element 18 on either side of the surfaces 12, 13. The frame elements 31, 32 are rigidly secured to the other elements of the frame.

The frame member 16 of the base cooperates with the frame element 22 to define a rectangular opening 42 through which a disc-shaped projectile such as 40 (FIG. 2) may pass. The frame member 17 of the base cooperates with the frame element 19 to define a rectangular opening 43 through which the projectile 40 may pass. In addition, the two frame members 16, 17 have an intervening space beneath the horizontal surface 12 forming an opening 41 beneath the horizontal surface through which the projectile 40 may also pass.

The angled frame element 31 cooperates with the frame elements 22 and 26 to define a triangular opening 46 on one side of the two surfaces 12, 13; and the angled frame element 32 cooperates with the frame elements 19 and 23 to define a second triangular opening 44 on the other side of the surfaces 12, 13. The disc-shaped projectile 40 may pass through the opening 41 in order to score points in the game. In addition, the projectile 40 may come to rest supported upon the surface 12 or leaning against the surface 13, partially supported by each surface.

In playing the game, a player stands a selected distance from the scoring platform 11 and sails the disc-shaped projectile 40 toward the platform. One point is awarded for touching the platform at any location, whether the projectile is airborne or rolling when contact is made. Two points are awarded whenever the projectile passes completely through the base of the platform, through the opening 41 beneath the surface 12. The projectile may be airborne or rolling. Three points are awarded when the projectile comes to rest, in any position, on the surface 12 between the frame elements 31, 32. The disc-shaped projectile may be resting entirely upon the surface 12 or in contact with both the surfaces 12 and 13.

The distance between a player and the scoring platform 11 may be selected as desired, with a presently preferred distance of 40 feet for an intermediate level player. A beginner would stand 30 feet from the scoring platform 11, and an advanced player would stand 50 feet from the platform.

Generally, the game is played by two players standing a selected distance from the platform 11. One or more disc-shaped projectiles are sailed by one player toward the scoring platform and the appropriate points recorded. The second player then takes a turn. The first "serve" is determined by sailing a disc, in the same manner as during a game, with the first or highest score after one throw determining the winner of the serve. Thereafter, the highest scorer wins the serve for the following throw. If no score is made, the service order remains the same as for the previous throw. The game is played to a score of 21 points, and the winner must win by 2 points. Both players can score on any one turn.

The game may also be played in a "doubles" format, utilizing two scoring platforms 11. The scoring platforms are separated the requisite distance, and a player of each partnership is at each of the two platforms. The game proceeds in the same manner as singles, and each time that the disc-shaped projectiles land at the opposite scoring platform, the points scored, if any, are added to the previous points for each partnership. The game is again played to 21 points, and each team can score on each turn.

In one particular form of scoring platform 11 which has been constructed, the rear, vertical, surface 13 is 15" wide and 14" tall. The horizontal surface 12 is 15" wide and 14" from front to rear. In this form of the scoring platform 11, the openings 42 and 43 are 14" from front to rear and 16" high, while the dimensions of the opening, or path, 41 beneath the surface 12 is 15" wide by 16" high. The vertical and horizontal sides of the triangular openings 44 and 46 are each 14" in this form of the scoring platform 11.

While the invention has been described in connection with a game employing a disc-shaped projectile such as the projectile 40, it will be understood that it is also applicable to games employing other similar types of projectiles, such as, for example, ring-shaped projectiles. In addition, while the scoring platform 11 has been described as having a rigid framework constructed of a plurality of rigidly connected frame elements, it would also be possible to form the scoring platform in such a manner that it is foldable or collapsible for storage or the like.

What is claimed is:

1. A game comprising (a) a scoring platform including a frame having a first generally horizontal surface and a second, generally vertical, surface having a lower edge contiguous with a rear edge of the horizontal surface, and a base including two spaced-apart frame members supporting opposite lateral edges of the horizontal surface, the spacing between the two said frame members defining an opening extending beneath the horizontal surface, said frame further including a first and a second frame element on opposite sides of the horizontal and vertical surfaces, each cooperating with a lateral edge of the horizontal surface and a lateral edge of the vertical surface to define first and second triangular openings, and (b) a disc-shaped projectile to be sailed by a player from a location remote from the frame toward the frame, with points awarded the player being dependent upon sailing the disc-shaped projectile through said opening or causing the disc-shaped projectile to come to rest on the horizontal surface or upon both the horizontal and the vertical surfaces.

2. A game comprising (a) a scoring platform including a frame having only a first generally horizontal surface and only a second, generally vertical, surface having a lower edge contiguous with a rear edge of the horizontal surface, and a base including two spaced-apart frame members supporting opposite lateral edges of the horizontal surface, the spacing between the two said frame members defining a first opening therebetween extending beneath the horizontal surface, which is sized to permit said projectile to pass therethrough along a first horizontal path, and (b) a disc-shaped generally flat projectile to be sailed by a player from a location remote from the frame toward the frame, said projectile having a size which is smaller than, but a substantial friction of, the size of each of said first and second surfaces and said first opening, said surfaces each being free of openings therein which would allow said projectile to pass therethrough, with points awarded the player being dependent upon sailing the disc-shaped projectile through said first opening or causing the disc-shaped projectile to come to rest on the horizontal surface or upon both the horizontal and the vertical surfaces.

3. The game of claim 2 wherein each of said spaced-apart frame members includes a second opening sized to permit said projectile to pass therethrough in opposite directions along a second generally horizontal path disposed perpendicularly to said first path, and wherein said first and second surfaces are approximately equal in size.

* * * * *